US011244774B2

(12) United States Patent
Miyagawa et al.

(10) Patent No.: US 11,244,774 B2
(45) Date of Patent: Feb. 8, 2022

(54) RESISTOR

(71) Applicant: KOA CORPORATION, Ina (JP)

(72) Inventors: Masaki Miyagawa, Ina (JP); Hironobu Nakajima, Ina (JP); Kyohei Miyashita, Ina (JP); Yuto Matsui, Ina (JP)

(73) Assignee: KOA Corporation, Nagano (JP)

( * ) Notice: Subject to any disclaimer, the term of this patent is extended or adjusted under 35 U.S.C. 154(b) by 0 days.

(21) Appl. No.: 17/058,203

(22) PCT Filed: May 17, 2019

(86) PCT No.: PCT/JP2019/019805
§ 371 (c)(1),
(2) Date: Nov. 24, 2020

(87) PCT Pub. No.: WO2019/225521
PCT Pub. Date: Nov. 28, 2019

(65) Prior Publication Data

US 2021/0183543 A1 Jun. 17, 2021

(30) Foreign Application Priority Data

May 25, 2018 (JP) ..... JP2018-100971

(51) Int. Cl.
*H01C 1/142* (2006.01)
*H01C 1/01* (2006.01)
(Continued)

(52) U.S. Cl.
CPC ..... *H01C 1/142* (2013.01); *H01C 1/01* (2013.01); *H01C 1/02* (2013.01); *H01C 1/084* (2013.01); *H01C 7/003* (2013.01)

(58) Field of Classification Search
CPC . H01C 1/142; H01C 1/01; H01C 1/02; H01C 1/084; H01C 7/003
See application file for complete search history.

(56) References Cited

U.S. PATENT DOCUMENTS 3,930,114 A * 12/1975 Hodge ..... H01L 23/4334 174/529
4,698,277 A * 10/1987 Bayer ..... B29C 37/0082 428/141
(Continued)

FOREIGN PATENT DOCUMENTS

JP S48-32609 Y1 10/1973
JP S62-91443 U 6/1987
(Continued)

*Primary Examiner* — Kyung S Lee
(74) *Attorney, Agent, or Firm* — Carrier Blackman & Associates, P.C.; Joseph P. Carrier; William D. Blackman

(57) ABSTRACT

A resistor includes: a first resin protruding part formed in the bottom surface of an exterior material (mold resin body), on an end opposite to a leading side of harness wires along the length of the exterior material near a through-hole piercing an upper surface and a lower surface of the exterior material, and a second resin protruding part, surrounding the circumference of a metal bush embedded in the through-hole and the entire circumference of the resistor substrate. Moreover, a concave part is formed in a region sandwiched between the first resin protruding part and the second resin protruding part.

14 Claims, 8 Drawing Sheets

(51) Int. Cl.

| | |
|---|---|
| ***H01C 1/02*** | (2006.01) |
| ***H01C 1/084*** | (2006.01) |
| ***H01C 7/00*** | (2006.01) |

(56) References Cited

U.S. PATENT DOCUMENTS

| | | | | | |
|---|---|---|---|---|---|
| 5,252,944 | A | * | 10/1993 | Caddock, Jr. | H01C 1/084 257/675 |
| 5,304,977 | A | * | 4/1994 | Caddock, Jr. | H01C 1/084 338/159 |
| 5,367,196 | A | * | 11/1994 | Mahulikar | H01L 23/4334 257/787 |
| 5,621,378 | A | * | 4/1997 | Caddock, Jr | H01C 1/084 338/51 |
| 6,316,726 | B1 | * | 11/2001 | Hidaka | H01G 4/228 174/538 |
| D769,832 | S | * | 10/2016 | Domon | H01C 1/084 D13/182 |
| 9,865,532 | B2 | * | 1/2018 | Glenn | H01L 23/3107 |

FOREIGN PATENT DOCUMENTS

| | | | |
|---|---|---|---|
| JP | H04-012676 | Y2 | 3/1992 |
| JP | H05-226106 | A | 9/1993 |
| JP | H11-504161 | A | 4/1999 |

* cited by examiner

RESISTOR

TECHNICAL FIELD

The present invention relates to a heat-radiating type power resistor (resistor for high power).

BACKGROUND ART

Power resistors may be used mounted on a heat absorber such as a mounting housing, heat sink, etc. For example, Patent Document 1 discloses a power resistor including an approximately rectangular main body made of synthetic resin formed around a resistive element having a resistive film that is provided on a ceramic substrate, a bolt hole passing through the main body, and a step part or a protruding part provided on the bottom surface near one end of the main body.

Patent Document 2 discloses a semiconductor device having a structure where a supporting plate on which a semiconductor chip is fixed and a part of an external lead wire are covered with a sealing resin. Patent Document 3 discloses a film-type resistor designed to be mountable on a printed circuit board, including a flat ceramic chip, a resistor film applied on a top surface of the ceramic chip, terminals electrically joined to the resistive film, and a synthetic resin main body in which front end sections of the terminals and the upper surface of the ceramic chip are embedded.

PRIOR ART DOCUMENTS

Patent Documents

Patent Document 1: JP H11-504161A (JP Patent No. 3756188)

Patent Document 2: Japanese Examined Utility Model Application Publication No. H04-012676A Patent Document 3: JP H05-226106A (JP Patent No. 2904654)

DISCLOSURE OF THE INVENTION

Problem to be Solved by the Invention

While the resistors described above, when mounted on a metal housing or the like, are fastened thereto by passing a screw through a through-hole formed in a resistor main body made from synthetic resin etc., they are likely to rotate around the screw fastened part due to vibrations etc. since the screw fastened side is fixed to the metal housing at that time, thereby needing to tightly fasten the screw as a preventative measure.

In Patent Document 1 described above, making the protruding part provided on the lower side of the resistor have a predetermined height, when passing a bolt through the bolt hole so as to fasten the resistor to a heat absorber, gives a structure compensating for warping or bending of a package body made of synthetic resin. Patent Document 3 has a structure allowing a bolt hole formed in the synthetic resin main body to receive a bolt, which extends through a corresponding hole in a flat base area, in order to firmly clamp the flat bottom surface of the substrate in the resistor against the flat base area in heat-transfer relationship.

However, with the structures of Patent Documents 1 and 3, if excessive torque is applied at the time of fastening a screw, a compressive force presses down on the resistive main body from the upper part, resulting in pressing a heat dissipating portion of the resistive main body down against the heat absorber, such as a metal housing, and thus there is fear of damage to the resistive main body or the internal resistor substrate.

The semiconductor device of Patent Document 2 includes paired concave parts formed sandwiching a through-hole in the back surface of sealing resin. However, there is a problem that corners of the back surface of the sealing resin do not touch the heat absorber even if a fastening torque is applied to the screw.

In light of this problem, the present invention aims to provide a resistor for high power having a structure that is capable of raising heat dissipation due to the resistor adhered to a mounting place, such as a metal housing, without damaging a sheathing resin body, resistor substrate, etc. even at the time of fastening a screw to the metal housing etc. or during use.

Means of Solving the Problem

The present invention aims to resolve the above problems, and includes the following structure, for example, as means for achieving the above aim. That is, the present invention is a resistor characterized by including: a resistor substrate made by forming a resistive element and paired electrodes on an insulation substrate; an insulating exterior material having an approximately rectangular parallelepiped overall shape covering at least an upper surface and side surfaces of the resistor substrate; and paired external connection conductors having one end parts connected to the respective paired electrodes, and other end parts passing through a longitudinal side surface of the exterior material and extending to the outside. A first protruding part is provided on the bottom surface of the other side surface side facing the one side surface of the exterior material at a position that sandwiches a through-hole formed piercing an upper surface and a lower surface of the exterior material and that separates from the bottom surface of the resistor substrate, which is exposed to the outside from the bottom surface; and a concave part depressed further on the exterior material side than the bottom surface of the resistor substrate along the thickness of the exterior material is provided between the first protruding part and the bottom surface of the resistor substrate.

For example, it is characterized in that a metal bush is embedded in the through-hole. It is characterized in that, for example, a second protruding part is provided, surrounding all or a part of an edge of the metal bush in the bottom surface of the exterior material, in a region from the edge part to a peripheral part on the metal bush side of the edge of the bottom surface of the resistor substrate. It is also characterized in that, for example, the second protruding part further extends surrounding the entire peripheral part of the bottom surface of the resistor substrate. It is further characterized in that, for example, the concave part is formed in a region sandwiched by the first protruding part and the second protruding part in the bottom surface of the exterior material. Yet even further, for example, it is characterized in that the second protruding part, the bottom surface of the resistor substrate, and the edge of the metal bush are at the same height along the thickness of the exterior material, and the first protruding part has a higher height than said same height. Yet even further, for example, it is characterized in that the first protruding part is either configured by a single protruding part extending along the entire width in an orthogonal direction to the longitudinal direction of the bottom surface of the exterior material while having a constant width, or configured by a regular shaped protruding part divided into either end part in the orthogonal direction to the longitudinal direction of the bottom surface of the exterior material. Yet even further, for example, it is characterized in that the resistor is mounted on a mounting object using a fastening body for passing through the through-hole, a protruding surface of the first protruding part makes surface contact with the mounting object, and the second protruding part adheres to the mounting object.

Results of the Invention

According to the present invention, a resistor, which relaxes stress applied to a mold resin body and a resistor substrate at the time of fastening a screw, resulting in prevention of damage to the mold resin body and the resistor substrate due to excessive torque, may be provided.

DESCRIPTION OF EMBODIMENTS

Embodiments according to the present invention are described in detail below with reference to accompanying drawings.

First Embodiment

Figure 1:
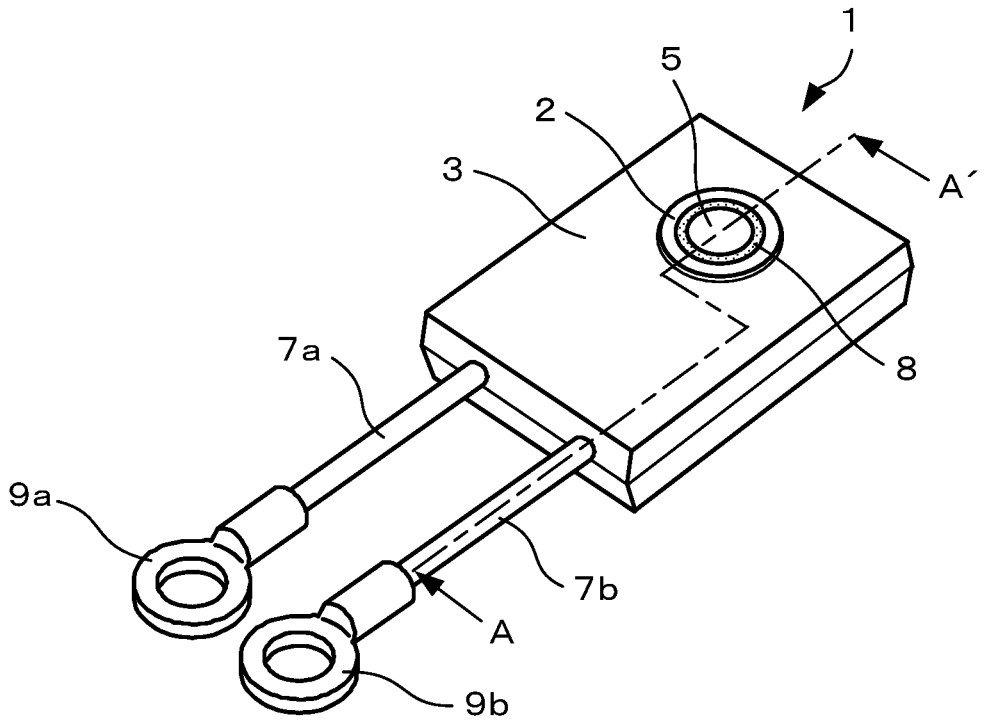
FIG. 1 is an external perspective diagram of a resistor (power resistor) according to a first embodiment of the present invention when viewed from the front side (upper side)
Figure 2:
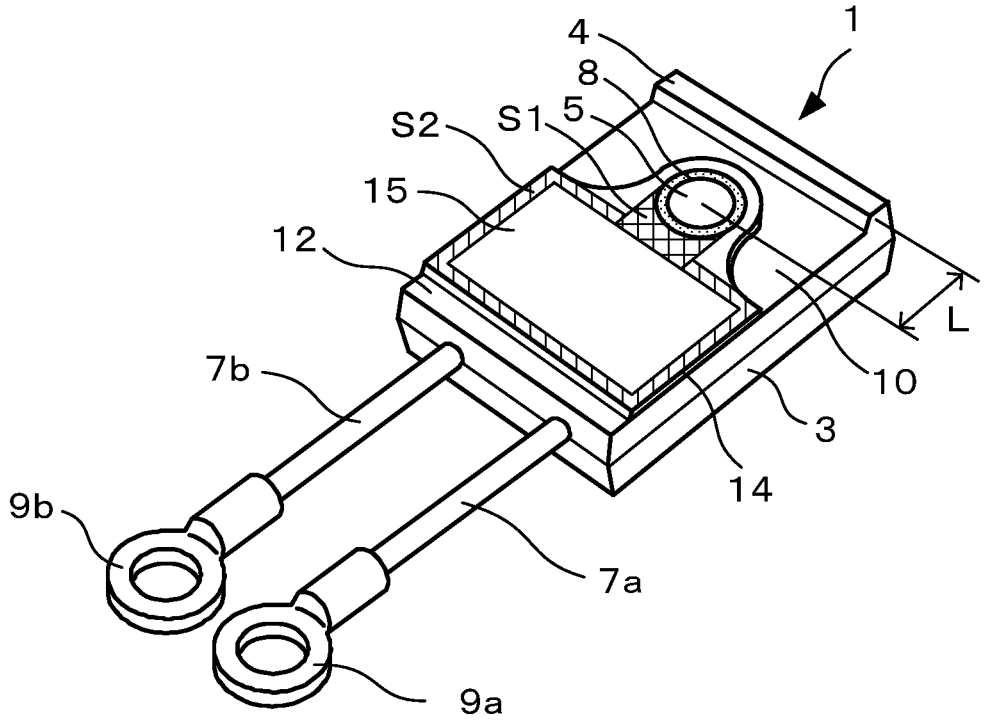
FIG. 2 is an external perspective diagram of the resistor according to the first embodiment when viewed from the back side (bottom side)
Figure 3:
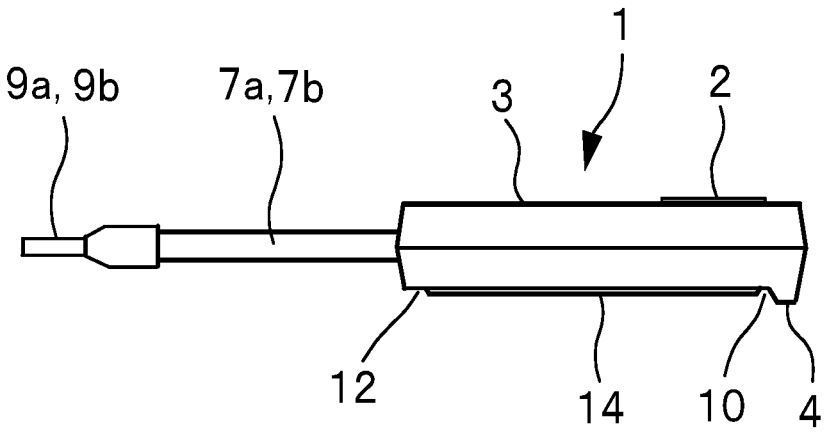
FIG. 3 is a side view of the resistor according to the first embodiment.

FIG. 1 is an external perspective diagram of a resistor (power resistor) according to a first embodiment of the present invention when viewed from the front side (upper side). FIG. 2 is an external perspective diagram of the resistor when viewed from the back side (bottom side). FIG. 3 is a side view of the resistor. Moreover, FIG. 4 is a cross section of the resistor according to the first embodiment when cut along a line indicated by arrows A-A of FIG. 1.

A resistor 1 according to the first embodiment illustrated in FIG. 1 etc. is a resistor for high power, having a structure including a resistor substrate 15 made by forming a resistive element and electrodes 23 on the surface of an insulation substrate 13 made of alumina etc. where external connection terminals (harness wires 7*a* and 7*b*) are connected to the electrodes 23, and a mold resin body 3 seals the resistor substrate 15 with both the back surface of the resistor substrate 15 and a part of the external connection terminals exposed to the outside.

More specifically, as illustrated in FIG. 2, it has a structure where the entire resistor substrate 15 except for the lower side is covered by insulating resin (also called mold resin or exterior resin), such as epoxy resin, with the lower side of the rectangular parallelepiped insulation substrate 13 made of alumina etc. being exposed from the mold resin body 3 or main body of the resistor 1. A thick film resistive element (omitted from the drawings) made of a ruthenium oxide-based material, for example, is formed on the top side of the insulation substrate 13 through screen printing, etc.

Figure 4:
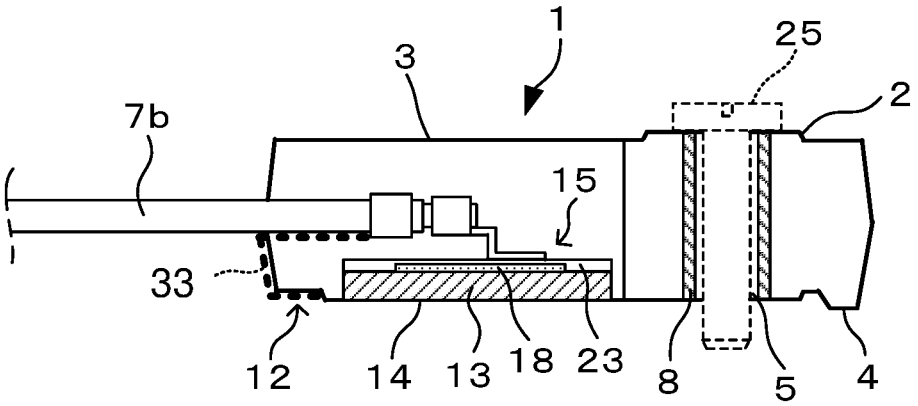
FIG. 4 is a cross section of the resistor according to the first embodiment when cut along a line indicated by arrows A-A' of FIG. 1.

As illustrated in FIG. 4, the coatings of the front ends (portions housed in the mold resin body 3) of the paired harness wires 7*a* and 7*b* pulled out to the outside from one end side of the mold resin body 3 are removed, crimped terminals are attached, which are then connected to the electrodes 23 through soldering, welding, ultrasonic joining, using a conductive adhesive, sintered cement, etc. Moreover, the crimped terminals attached to the harness wires 7*a* and 7*b* are bent in a crank shape near joining parts to the electrodes 23. This prevents them from touching the surface of the resistor substrate 15 and a glass protective film to be described later, as well as secures strength against external tensile stress.

Round terminals (ring terminals) 9*a* and 9*b* for connecting the harness wires 7*a* and 7*b* to other electrical apparatus, components, etc. using screws or the like are crimped to the respective other ends (front ends of portions exposed from the mold resin body 3) of the harness wires 7*a* and 7*b* through caulking etc. While round terminals are used in this embodiment, type of terminals is not limited thereto, and Y-shaped terminals etc. may be used. Since the harness wires 7*a* and 7*b* are covered by resin, insulation between terminals such as lead terminals to be described later does not need to be secured.

That is, a short-circuit etc. does not occur even if the harness wires 7*a* and 7*b* touch other metal portions after the resistor 1 is mounted, thereby allowing a wiring structure where the harness wires 7*a* and 7*b* are close to each other when mounting the resistor 1 in a device etc.

A through-hole 5 passing between the front side and the back side of the mold resin body 3 is formed along the length of the mold resin body 3 near an end part opposite to the side on which the resistor substrate 15 is arranged. The through-hole 5 is a screw fastening part (screw hole in which a screw 25 is inserted) for conducting to the metal housing or the like the heat generated by a resistive element 18, which is formed in the resistor substrate 15, and releasing heat, when the resistor 1 is attached to a heat sink or a metal housing made of an aluminum die cast etc.

A cylindrical metal bush 8 is embedded in the through-hole 5. The metal bush 8 allows prevention of slippage from occurring when the resistor 1 that is sealed by the mold resin body 3 is screw fastened and made direct contact with the metal housing at the mounting place, thereby enabling secure attachment through screw fastening of the metal bush 8 to the metal housing. Moreover, embedment of the metal bush 8 in the through-hole 5 reinforces the inner wall etc. of the through-hole 5, allowing prevention of cracks etc. from forming in the mold resin body 3 due to vibrations during use, and improvement in reliability at the time of mounting the resistor 1.

The metal bush 8 is made of stainless steel, copper, iron, etc., and is manufactured by cutting these metal materials to a predetermined size so as to roll it into a cylinder, etc. Note that in the case where either the mounting place for the resistor 1 is not made of metal, or use in an application with which vibration etc. is not a problem, the metal bush may be omitted.

Focusing on the top surface and the bottom surface of the resistor 1 according to the first embodiment illustrated in FIG. 1 and FIG. 2, the bottom surface of the resistor substrate 15 is exposed from the back surface (FIG. 2) of the resistor 1; and a first resin protruding part 4, a second resin protruding part 14, a concave part (also referred to as fragile part) 10, and a step part 12 are formed by protruding or embedding a part of the mold resin body 3 in a predetermined shape. Moreover, a third resin protruding part 2 made by lifting up the mold resin body 3 around the metal bush 8 is formed in the front surface (FIG. 1) of the resistor 1 so as to be in the same surface as an axial end part of the metal bush 8.

The first resin protruding part 4 is formed in a bottom end part opposite to a leading side of external connection conductors (harness wires 7*a* and 7*b*) sandwiching the through-hole 5 along the length of the mold resin body 3. The second resin protruding part 14 is formed in the back surface (FIG. 2) of the resistor 1 along the entire circumference of the resistor substrate 15 and surrounds the circumference of the metal bush 8 so as to be in the same surface as the axial end part of the metal bush 8. The concave part 10, which is recessed more on the mold resin body side than in the bottom surface of the resistor substrate 15, is formed in a region surrounded by (sandwiched between) the first resin protruding part 4 and the second resin protruding part 14.

Figure 5:
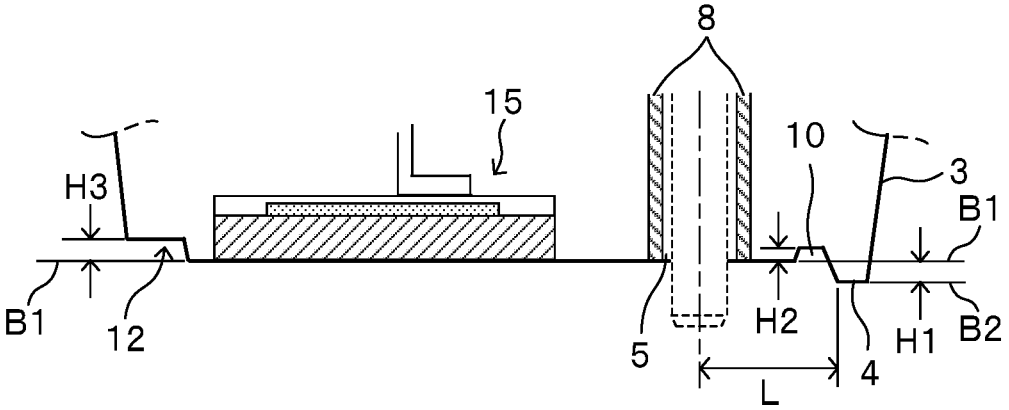
FIG. 5 is a cross section of the resistor according to the first embodiment giving dimensions of the respective protruding parts and the concave parts formed in the bottom surface along the thickness of the resistor.

FIG. 5 is a cross section of the resistor 1 giving dimensions of the respective protruding parts and the concave part formed in the bottom surface along the thickness of the resistor. When the bottom surface of the resistor substrate 15 is set as a reference height (indicated by reference line B1), height (indicated by reference line B2) H1 from the reference line B1 to the apex of the first resin protruding part 4 is the highest point of the bottom surface part of the resistor 1. For example, the first resin protruding part 4 is formed at H1, 0.05 mm higher than the bottom surface of the resistor substrate 15.

The first resin protruding part 4 has a flat part having a flat highest portion (apex) that is formed across the entire width, orthogonal to the longitudinal direction of the mold resin body 3, between either end of the mold resin body 3. When the resistor 1 is screw-fastened and mounted on the mounting place, this flat part makes surface contact with the mounting place. In doing so, stress applied at the time of fastening using a screw (fastening body) is relaxed by the first resin protruding part 4, allowing dispersion of the stress.

Applied pressure from a screw head when screw fastening is also relaxed by the third resin protruding part 2, thereby dispersing the stress on the mold resin body 3. Note that as long as the aim of dispersing stress is reached, the apex of the first resin protruding part 4 may have a gently rounded, ridge-like shape.

With the resistor 1 according to the first embodiment, use of the second resin protruding part 14 formed surrounding the circumference of the metal bush 8 and the entire circumference of the resistor substrate 15, as illustrated in FIG. 2, aligns heights of the metal bush 8 and the resistor substrate 15 in the bottom surface part of the resistor 1, as illustrated in FIG. 5. That is, the second resin protruding part 14 makes the height of the mold resin body 3 uniform from the metal bush 8 to the resistor substrate 15.

This is because chipping of the mold resin body 3 and the resistor substrate 15 may occur during manufacturing or use of the resistor, or scratching, chipping, cracking etc. may occur in the mold resin body 3, the resistor substrate 15, or mounting place due to compressive force at the time of fastening a screw when the metal bush 8 and the resistor substrate 15 are protruding from the bottom surface of the mold resin body 3.

On the contrary, when the metal bush 8 and the resistor substrate 15 recede from the bottom surface (penetrate into the resistor 1), problems that mounting becomes unstable and that sufficient adhesion to the mounting place and the resistor substrate 15 cannot be secured, etc. occur.

Note that the aim may be reached with the second resin protruding part 14 if the mold resin body 3 is protruded in a range (portion indicated by S1 in FIG. 2) at least from an end part on the through-hole 5 side of the resistor substrate 15 to a lower half of the peripheral part of the metal bush 8 surrounding the resistor substrate 15 side.

On the other hand, the second resin protruding part 14 has a resin protruding part formed in the entire circumference (range indicated by S2 in FIG. 2) of the resistor substrate 15, as illustrated in FIG. 2, with consideration of design of a mold that accepts dimensional tolerance of the resistor substrate 15. As a result, in addition to merits of making design and manufacturing simple, making the resin protruding part surround the circumference of the resistor substrate 15 allows prevention of chipping, scratching, etc. of the resistor substrate 15, control of fluctuation in protruding height of the resistor substrate 15, and achievement of favorable heat dissipation by adhering to the mounting place.

With the resistor 1 according to the first embodiment, the first resin protruding part 4, as described above, is provided in the longitudinal end part of the mold resin body 3 opposite to the leading side of the external connection conductors (harness wires 7*a* and 7*b*), near the through-hole 5 in the bottom surface. As a result, when passing and tightening an attachment screw through the metal bush 8 of the through-hole 5, the bottom end part of the resistor main body (mold resin body 3) on the opposite longitudinal side to side on which the first resin protruding part 4 is formed may be pressed on the mounting place and adhered thereto. That is, the first resin protruding part 4 acts so as to press the resistor substrate 15 on the mounting place when screw-fastening the resistor 1.

Moreover, with the resistor 1 according to the first embodiment, correlation is given to height H1 of the first resin protruding part 4 and distance L from the end part of the first resin protruding part 4 to the center of the through-hole 5. For example, the higher the first resin protruding part 4, the larger distance L, and the lower the first resin protruding part 4, the smaller distance L. Furthermore, height H1 of the first resin protruding part 4 may be decided with further consideration of distance from the end part of the resistor substrate 15, distance from the end part of the second resin protruding part 14, size (resistor size) of the entire resistor 1 etc.

While the resistor 1 according to the first embodiment has a structure including the metal bush 8 that controls effects on the resistor 1 even in the case of excessive torque applied at the time of fastening a screw, the first resin protruding part 4 may become too high due to dimensional tolerance etc. of the mold design for the mold resin body 3. In that case, damage by cracks forming in the resistor 1 due to compressive force at the time of fastening a screw is a matter of concern.

Therefore, the resistor 1 according to the first embodiment has the concave part 10 so that even if the resistor 1 is damaged, only places that do not affect the resistor substrate inside of the resistor are damaged. The concave part 10, as illustrated in FIG. 2, FIG. 5, etc., is formed in a region of the bottom surface of the mold resin body 3, wherein the region is sandwiched by the first resin protruding part 4 and the second resin protruding part 14 and is opposite to the leading side of the external connection conductors (harness wires 7*a* and 7*b*). The concave part 10 is formed so as to be lower (height H2) than the bottom surface of the resistor substrate 15, set as a reference height (reference line B1).

From the view point of maintaining insulation at the time of mounting the resistor etc., it is necessary to secure a creeping distance (in the case of a resistor, distance along the surface between the conductive part thereof and the metal housing at the mounting place) or minimum distance between two conductive parts along the surface of an insulating material. Therefore, with the resistor 1 according to the first embodiment, the step part 12 is formed in the leading side end parts of the external connection conductors on the bottom surface of the mold resin body 3, as illustrated in FIG. 2, FIG. 4, etc.

The step part 12 can secure a creeping distance along a path indicated by a dotted line 33 in FIG. 4. Since the harness wires 7*a* and 7*b* are used in the resistor 1 illustrated in FIG. 4 for connecting to the outside, a long creeping distance from the joining parts between the harness wires and the electrodes 23 to the mounting substrate may be secured.

The step part 12 plays a role in securing a creeping distance, and also provides the result in preventing chipping, cracks etc. of corners or rims of the mold resin body 3 and the resistor substrate 15 at the time of fastening a screw etc. Height H3 of the step part 12 as illustrated in FIG. 5 is formed either at the same height (H2) as the concave part 10 or the lowest part of the bottom surface part of the resistor 1 when the height of the bottom part of the resistor substrate 15 is set as a reference (reference line B1).

Figure 6A:
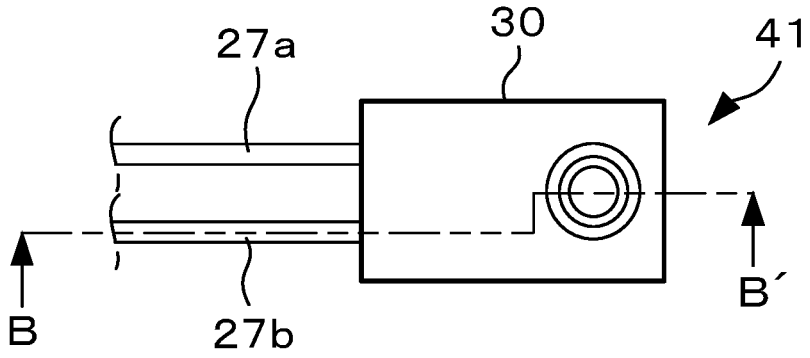
FIGS. 6A-6B are diagrams exemplifying a resistor (power resistor) having external connection conductors as lead terminals.
Figure 6B:
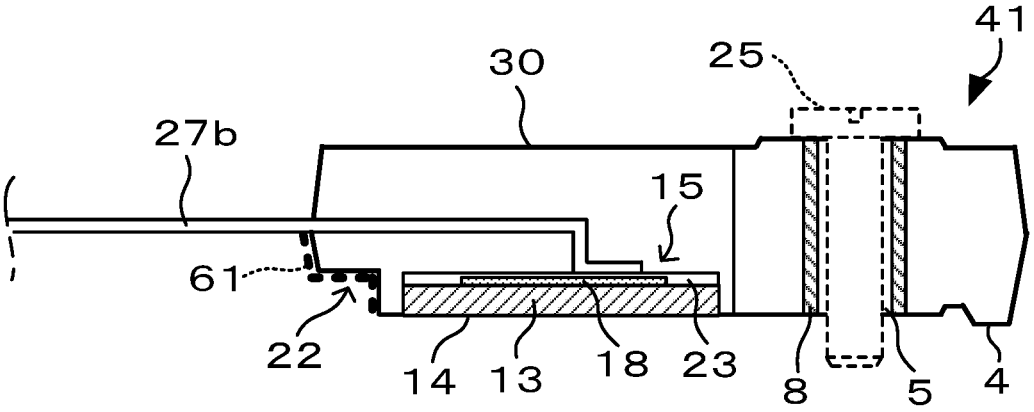

The external connection conductors of the resistor according to the first embodiment are not limited to the harness wires 7*a* and 7*b* described above. FIGS. 6A-6B exemplify a resistor (power resistor) 41 having lead terminals as the external connection conductors. FIG. 6A is a plan view of a resistor 41 when viewed from the front side (upper side), and FIG. 6B is a cross section cut along a line indicated by arrows B-B' in FIG. 6A. Note that in FIGS. 6A-6B, the same components as in the resistor 1 illustrated in FIG. 4 using harness wires are given the same reference numerals, and description thereof is omitted here.

The resistor 41 of FIGS. 6A-6B has lead terminals 27*a* and 27*b* resulting from either applying metal plating on the surface of wire material made of copper, etc., or using wire material that has an insulating coating applied on the surface except for joining parts to the electrodes 23 formed on the insulation substrate 13. The lead terminals 27*a* and 27*b* are also bent in a crank shape near the joining parts to the electrodes 23, as illustrated in FIG. 6B, in the same manner as the harness wires 7*a* and 7*b* described above.

With the resistor 41, the lead terminals 27*a* and 27*b* that are uncovered and exposed to the outside of the mold resin body 3 are used as external connection conductors. Therefore, securing a creeping distance is important, and as illustrated in FIG. 6B, for example, a step part 22 is formed in an end part on the leading side of the external connection conductors so as to secure a creeping distance along a path indicated by a dotted line 61.

Figure 7:
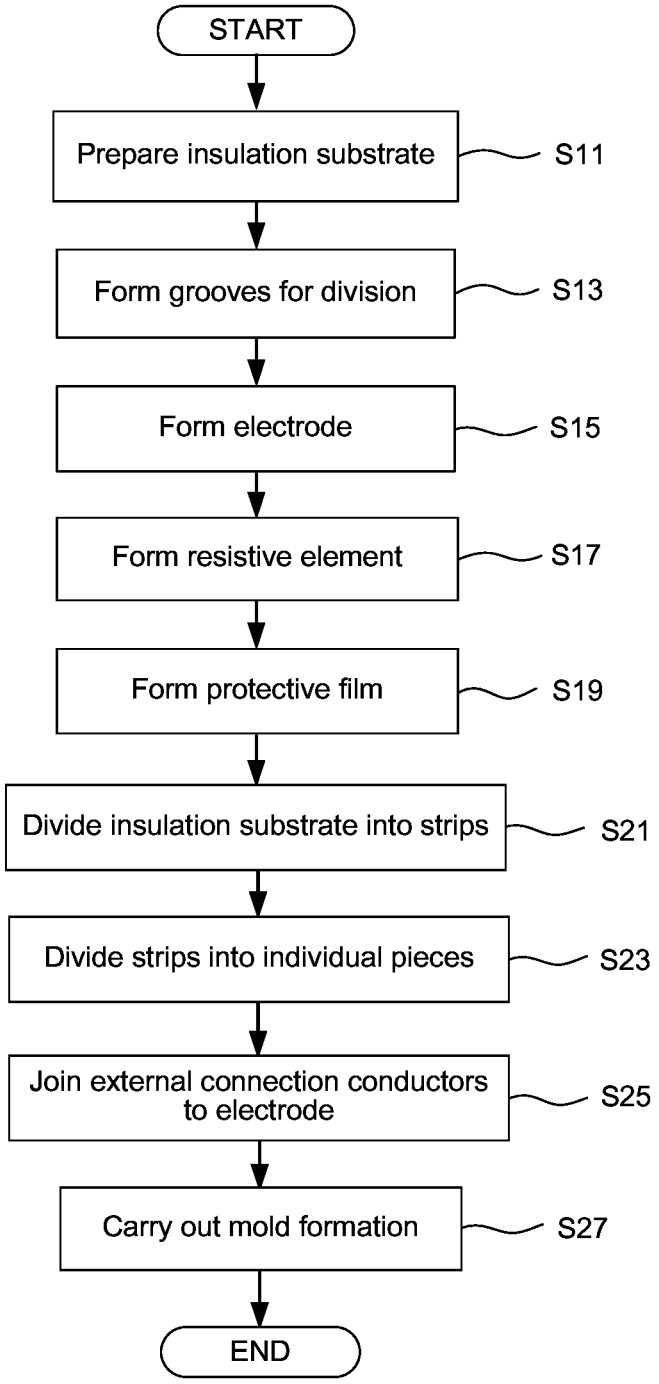
FIG. 7 is a flowchart showing resistor manufacturing steps in time series according to the first embodiment.

Next, a resistor manufacturing method according to the first embodiment is described. FIG. 7 is a flowchart showing resistor manufacturing steps in time series according to the first embodiment. In step S11 of FIG. 7, an insulation substrate for the resistor is prepared. Here, a large insulation substrate for dividing into many pieces made from an alumina substrate, for example, having excellent electric insulation and thermal conductivity is prepared. Next in step S13, grooves for primary division and grooves for secondary division are formed as grooves for dividing the substrate in the front surface and the back surface of the insulation substrate.

In step S15, paired electrodes having a predetermined shape are screen-printed on the substrate and then baked. A silver (Ag) or silver-palladium (Ag—Pd) electrode paste, for example, is used as an electrode material. Then in step S17, a resistive element paste is screen-printed between the paired electrodes described above, and then baked, thus forming a resistive element with a predetermined pattern. Note that regarding the order of steps S15 and 17, the step of forming electrodes may be carried out after the step of forming a resistive element.

In step S19, glass is printed so as to cover the entire upper surface of the insulation substrate on which the resistive element etc. is formed, thereby forming a protective film. At this time, without printing glass on portions to be joining parts to the harness wires on the electrode, rectangular parallelepiped holes, for example, are formed in regions where the joining parts described above of the protective film are positioned. That is, while the protective film here is a glass-coated film covering the entire upper part of the insulation substrate, a film is not formed on the joining parts to the harness wires, and thus the rectangular parallelepiped holes described above are formed in the portions positioned at the joining parts.

In step S21, primary division using the grooves provided in advance in one direction of the substrate as division lines is carried out so as to divide the substrate into strips. In subsequent step S23, secondary division is carried out for the substrate divided into strips in the above manner along the grooves provided in advance in an orthogonal direction to the one direction so as to divide the resistor into individual pieces.

In step S25, the external connection conductors are joined to the electrodes. In the case of using harness wires as the external connection conductors, harness wires are prepared having crimped terminals attached to one ends from where a predetermined length of coating is removed, and also having ring terminals attached to the other ends, so as to lead the one ends of the harness wires into the rectangular parallelepiped holes formed in the protective film as described above. The one ends of the harness wires and the joining parts on the electrode are joined through soldering, welding, etc. The ring terminals on the other ends may be attached after step S27 described later.

In the case of using lead terminals as the external connection conductors, the one ends bent in a crank shape are joined to the electrodes 23 through soldering or welding, as illustrated in FIG. 6B.

In step S27, the through-hole 5 for fastening a screw is formed by carrying out mold formation, covering all of the upper surface side and the side surface side of the resistor substrate using an insulating resin such as epoxy resin, exposing only the lower surface, and embedding a cylindrical metal bush along the wall surface.

Note that in a step after the resistive element is formed, for example, resistance value may be measured between electrodes, and based on that value, a notch may be made in the resistive element pattern using a laser beam, sand blast, etc. so as to adjust (trim) the resistance value of the resistive element. Moreover, a separate resin protective film apart from the mold resin body may be formed on the glass protective film described above.

The resistor according to the first embodiment as described above has, in the bottom surface of the mold resin body or main body of the resistor, the first resin protruding part on the end opposite to the leading side of the external connection conductors along the length of the mold resin body near the through-hole, and the second resin protruding part surrounding the circumference of the metal bush embedded in the through-hole and the entire circumference of the resistor substrate.

When passing and tightening an attachment screw through the through-hole when mounting the resistor on the mounting place, the first resin protruding part allows dispersion of applied stress and also allows pressing against and adhering to the mounting place, the bottom end (bottom surface of the resistor substrate) of the resistor main body (mold resin body) on the opposite longitudinal side to the side on which the protruding part is formed. Moreover, the second resin protruding part, which aligns heights of the metal bush and the resistor substrate in the bottom surface of the resistor, allows prevention of chipping of the mold resin body and the resistor substrate from occurring during manufacturing or use of the resistor, or scratching, chipping and cracking from occurring in the mold resin body, the resistor substrate, or mounting place due to compressive force at the time of fastening a screw.

Furthermore, formation of a concave part that is lower than the bottom surface of the resistor substrate, which is exposed to the outside from the bottom surface of the resistor, in a region of the bottom surface of the mold resin body sandwiched between the first resin protruding part and the second resin protruding part opposite to the side on which the external connection conductors are led, allows damaging of places that do not affect the resistor substrate inside of the resistor even if the resistor is damaged at the time of fastening a screw etc.

Second Embodiment

Figure 8:
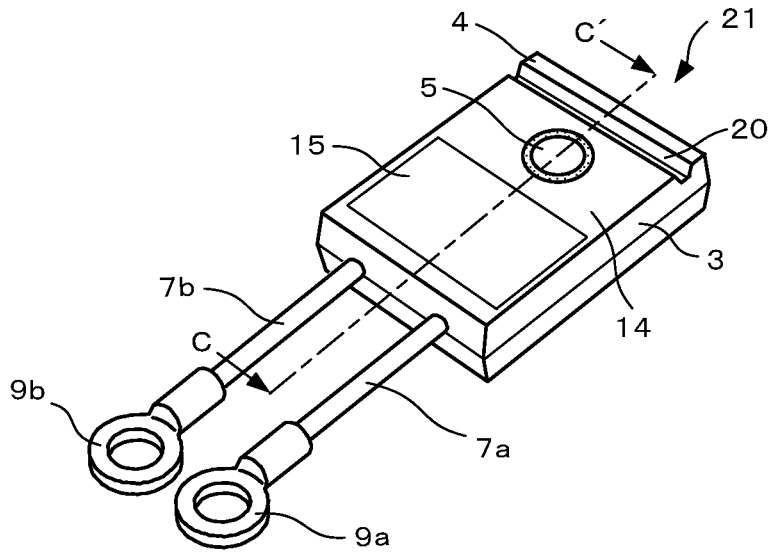
FIG. 8 is an external perspective diagram of a resistor according to a second embodiment when viewed from the back side.
Figure 9:
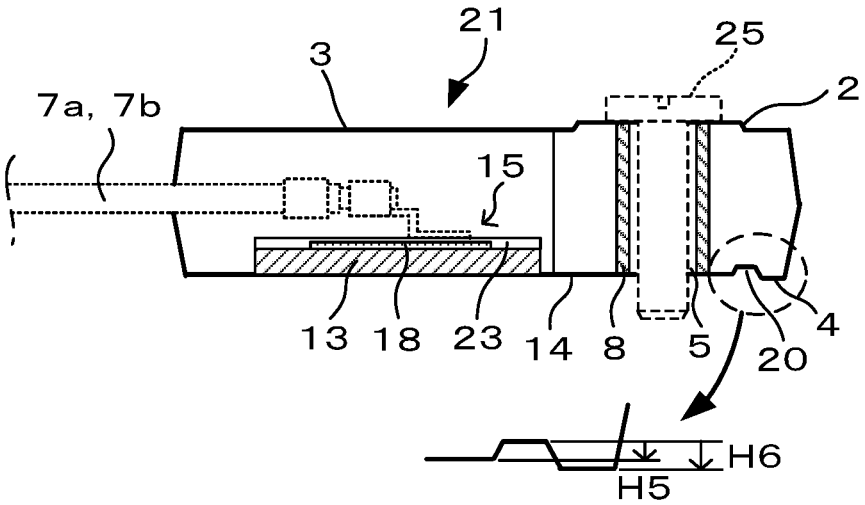
FIG. 9 is a cross section of the resistor of FIG. 8 when cut along a line indicated by arrows C-C' with the back surface being arranged on the lower side.

FIG. 8 is an external perspective diagram of a resistor (power resistor) according to a second embodiment of the present invention when viewed from the back side (bottom side). FIG. 9 is a cross-section of the resistor of FIG. 8 when cut along a line indicated by arrows C-C' with the back surface being arranged on the lower side. In FIG. 8 etc., the same composition as the resistor according to the first embodiment is given the same reference numerals. Moreover, the external appearance of the resistor according to the second embodiment when viewed from the top side (upper side) is the same as in FIG. 1, and is thus omitted from the drawings.

As illustrated in FIG. 8 etc., with a resistor 21 according to the second embodiment that is a resistor for high power, the bottom surface of the resistor substrate 15 is exposed from the resistor bottom surface side. Moreover, the resistor 21 includes the first resin protruding part 4, which is formed in an end part (bottom end) of the longitudinal ends of the mold resin body 3 opposite to the side on which the resistor substrate 15 is arranged and which extends in an orthogonal direction (widthwise direction) to the longitudinal direction of the mold resin body 3 while protruding in a ridge-like shape.

Furthermore, the second resin protruding part 14 is formed in the back surface of the resistor 21 along the entire circumference of the resistor substrate 15, and surrounding the circumference of the metal bush 8 so as to be in the same surface as the axial end of the metal bush 8. The concave part 20 extending linearly in the widthwise direction of the mold resin body 3 is formed between the first resin protruding part 4 and the second resin protruding part 14.

With the resistor 21, height H5 (height of the second resin protruding part 14) of the bottom surface of the resistor substrate 15 when the bottom surface of the concave part 20 of the resistor 21 is set as a reference is lower than height H6 of the apex of the first resin protruding part 4 having the bottom surface of the concave part 20 as a reference, as illustrated in the cross section of FIG. 9 by enlarging the region surrounded by a broken line.

That is, since the bottom surface of the concave part 20 is at the lowest position and the first resin protruding part 4 is at the highest position, the bottom surface part of the resistor 21 includes the bottom surface of the concave part 20, the bottom surface of the resistor substrate 15, and the first resin protruding part 4 formed in this height increasing order. As a result, the height of the first resin protruding part 4 may be secured relatively, and thus when screw-fastening the resistor 21 and mounting it on the mounting place, pressing the bottom surface of the resistor substrate 15 on the surface of the mounting place is easier, and favorable heat release due to adhered surface contact may be implemented.

Third Embodiment

Figure 10:
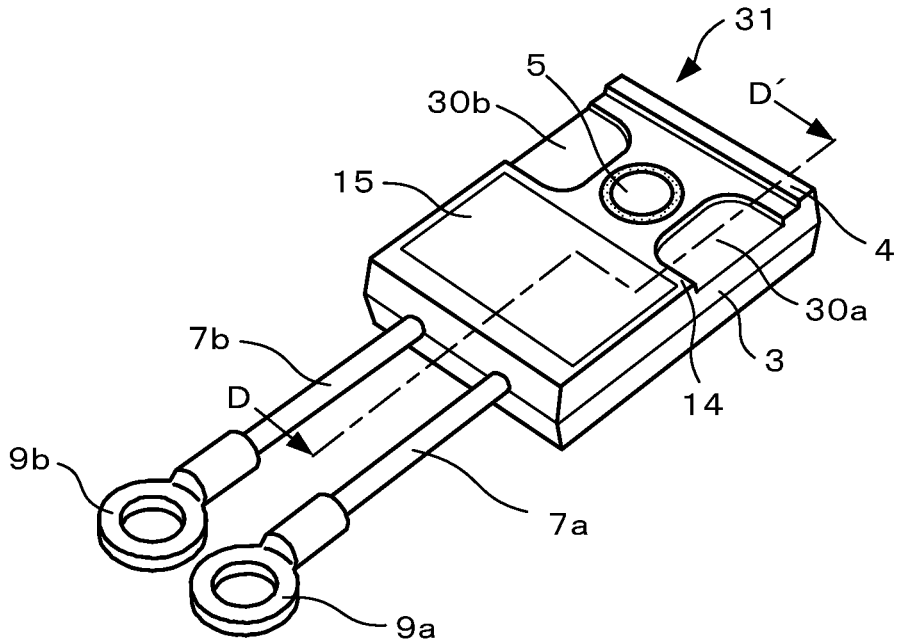
FIG. 10 is an external perspective diagram of a resistor according to a third embodiment when viewed from the back side.
Figure 11:
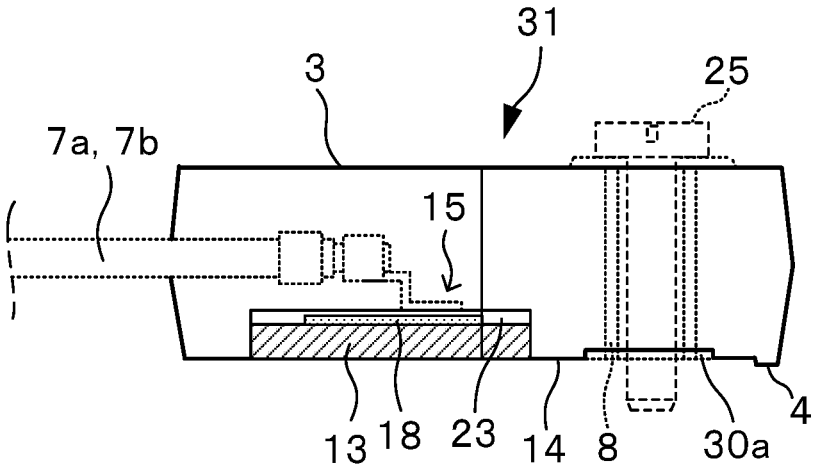
FIG. 11 is a cross section of the resistor of FIG. 10 when cut along a line indicated by arrows D-D' with the back surface being arranged on the lower side.

FIG. 10 is an external perspective diagram of a resistor (power resistor) according to a third embodiment when viewed from the backside (bottom side). FIG. 11 is a cross-section of the resistor of FIG. 10 when cut along a line indicated by arrows D-D' with the back surface being arranged on the lower side. In FIG. 10 etc, the same composition as the resistor according to the first embodiment is given the same reference numerals. Moreover, the external appearance of the resistor according to the third embodiment when viewed from the top side (upper side) is the same as in FIG. 1, and is thus omitted from the drawings.

The bottom surface of the resistor substrate 15 is exposed from the bottom side of a resistor 31 according to the third embodiment illustrated in FIG. 10 etc. Moreover, the bottom side includes the first resin protruding part 4, which is formed in an end part (bottom end) of the longitudinal ends of the mold resin body 3 opposite to the side on which the resistor substrate 15 is arranged and which extends in an orthogonal direction (widthwise direction) to the longitudinal direction of the mold resin body 3 while protruding in a ridge-like shape.

The second resin protruding part 14 is formed in the back surface of the resistor 31 along the entire circumference of the resistor substrate 15, and surrounding the circumference of the metal bush 8 so as to be in the same surface as the axial end of the metal bush 8. Moreover, paired concave parts 30*a* and 30*b* are formed between the first resin protruding part 4 and the resistor substrate 15, facing each other and sandwiching the through-hole 5 for fastening a screw in the widthwise direction of the mold resin body 3.

The concave parts 30*a* and 30*b* have one end parts as a part of the longitudinal ends of the mold resin body 3, and the other end parts connected in the vicinity of the through-hole 5 to low wall-shaped parts which extend linearly in the widthwise direction of the mold resin body 3 from either end of the one end parts. These connecting parts have roundness in a planar view.

In this manner, since the concave parts 30*a* and 30*b* are formed between the first resin protruding part 4 and the resistor substrate 15, that is, in two places near the through-hole 5 (metal bush 8) where the most torque is applied when screw-fastening the resistor 31, the concave parts 30*a* and 30*b* are easily cracked when excessive torque is applied. As a result, damaging places that do not affect the resistor substrate 15 inside the resistor 31 is possible, thereby reducing effect of excessive torque on the resistor substrate 15.

Note that shape of the concave parts 30*a* and 30*b* is not limited to the example given in FIG. 10, and may be approximately rectangular, semicircular, or trapezoidal in a planar view. In those cases, corners are given roundness from a viewpoint of ease of filling resin and ease of removal from the mold (does not chip formed portions easily) at the time of mold formation.

Modified Examples

Figure 12A:
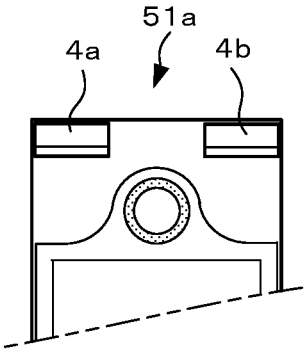
FIGS. 12A-12D are diagrams illustrating modified examples of a first resin protruding part.
Figure 12B:
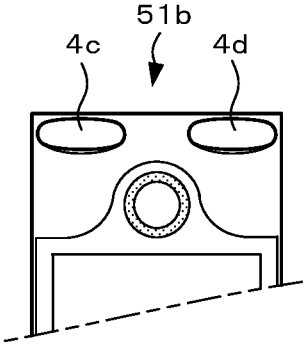
Figure 12C:
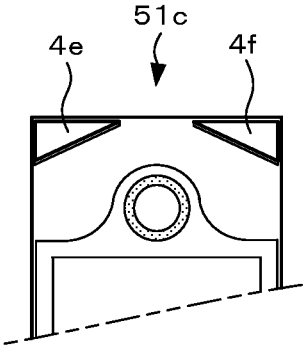

The present invention is not limited to the embodiments described above, and various modifications are possible. For example, the first resin protruding part 4, which is provided on a longitudinal end part of the mold resin body opposite to the leading side of the external connection conductors of the resistor, is not limited to the shape illustrated in FIG. 2 etc. FIGS. 12A to 12C illustrate the bottom surface of a resistor according to modified examples in planar views, wherein a resistor 51*a* of FIG. 12A is a resistor end part opposite to the leading side of the external connection conductors (omitted from the drawings), and two rectangular protruding parts 4*a* and 4*b* arranged at a distance from each other at either end part in an orthogonal direction to the longitudinal direction of the resistor are set as the first resin protruding part.

Similarly, a resistor 51*b* of FIG. 12B is a resistor end part, and two elliptical protruding parts 4*c* and 4*d* arranged at a distance from each other at either end part in an orthogonal direction to the longitudinal direction of the resistor are set as the first resin protruding part. Moreover, a resistor 51*c* of FIG. 12C is an example of making two triangular protruding parts 4*e* and 4*f* arranged at a distance from each other at either end part of the resistor end part as the first resin protruding part.

Figure 12D:
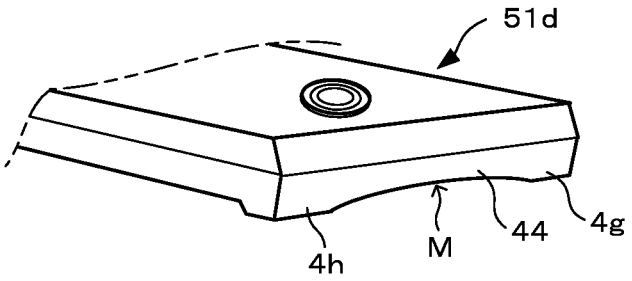

On the other hand, FIG. 12D shows the external appearance of a resistor 51*d* having a protruding part 44 according to a modified example of the first resin protruding part 4 illustrated in FIG. 2 etc. The protruding part 44 extending in an orthogonal direction to the longitudinal direction of the bottom end part of the resistor 51*d* has a shape where a center part M is lower than both end sides in the longitudinal direction, and the both end sides form convex parts 4*g* and 4*h* with flat apexes. Accordingly, formation of two protruding parts 4*a* to 4*f* by dividing into either lateral end of the resistor as the first resin protruding part, as illustrated in FIG. 12A to FIG. 12C, and formation of the convex parts 4*g* and 4*h* having both end sides higher than the center part, as with the protruding part 44 illustrated in FIG. 12D, allow reduction of lateral warping of the mold resin body, and improvement in adhesion to the mounting place.

Figure 13:
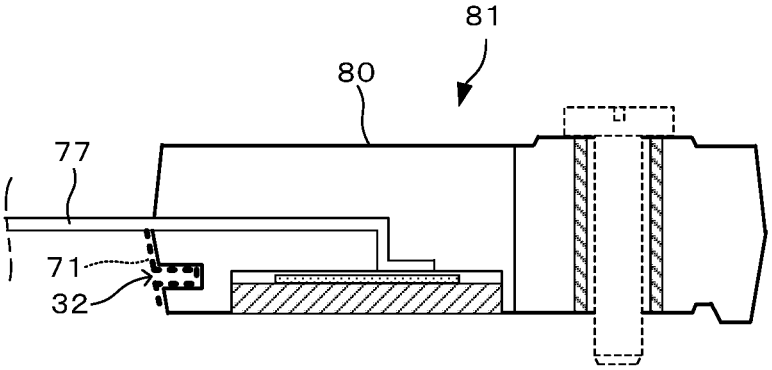
FIG. 13 is a diagram illustrating a modified example of a step part formed in mold resin.

Moreover, the shape of the step part provided in the end part on the leading side of an external connection conductor for securing a creeping distance is also not limited to the examples illustrated in FIG. 4 and FIG. 6B. For example, in the example of FIG. 13, a step part 32 shaped having a notch formed on the inner side of a mold resin body 80 is formed in a resistor 81 from which a lead terminal 77 is exposed to the outside of the mold resin body 80 as an external connection conductor. As a result, a creeping distance along a path (between mounting substrate and lead terminal that makes up a conductor) indicated by a dotted line 71 may be secured.

EXPLANATION OF REFERENCES

1, 21, 31, 41, 51*a*-51*d*, 81: Resistor
2: Third resin protruding part
3, 30, 80: Mold resin body
4: First resin protruding part
4*a*-4*f*, 44: Protruding part
4*g*, 4*h*: Convex part
5: Through-hole
7*a*, 7*b*: External connection terminal (harness wire)
8: Metal bush
9*a*, 9*b*: Round terminal (ring terminal)
10, 20, 30*a*, 30*b*: Concave part (fragile part)
12, 22, 32: Step part
13: Insulation substrate
14: Second resin protruding part
15: Resistor substrate
18: Resistive element
23: Electrode
25: Screw
27*a*, 27*b*: Lead terminal

The invention claimed is:

1. A resistor comprising:

a resistor substrate made by forming a resistive element and paired electrodes on an insulation substrate;

an insulating exterior material having an approximately rectangular parallelepiped overall shape covering at least an upper surface and side surfaces of the resistor substrate; and paired external connection conductors having one end parts connected to the respective paired electrodes, and other end parts passing through a longitudinal side surface of the exterior material and extending to the outside, wherein a first protruding part is provided on the bottom surface of the other side surface side facing the one side surface of the exterior material at a position that sandwiches a through-hole formed piercing an upper surface and a lower surface of the exterior material and that separates from the bottom surface of the resistor substrate, which is exposed to the outside from the bottom surface, and a concave part depressed further on the exterior material side than the bottom surface of the resistor substrate along the thickness of the exterior material is provided between the first protruding part and the bottom surface of the resistor substrate.

2. The resistor according to claim 1, wherein a metal bush is embedded in the through-hole.

3. The resistor according to claim 2, wherein a second protruding part is provided, surrounding all or a part of an edge of the metal bush in the bottom surface of the exterior material, in a region from the edge part to a peripheral part on the metal bush side of the edge of the bottom surface of the resistor substrate.

4. The resistor according to claim 3, wherein the second protruding part further extends surrounding the entire peripheral part of the bottom surface of the resistor substrate.

5. The resistor according to claim 4, wherein the concave part is formed in a region sandwiched by the first protruding part and the second protruding part in the bottom surface of the exterior material.

6. The resistor according to claim 4, wherein the second protruding part, the bottom surface of the resistor substrate, and the edge of the metal bush are at the same height along the thickness of the exterior material, and the first protruding part has a higher height than said same height.

7. The resistor according to claim 4, wherein when the resistor is mounted on a mounting object using a fastening body for passing through the through-hole, a protruding surface of the first protruding part makes surface contact with the mounting object, and the second protruding part adheres to the mounting object.

8. The resistor according to claim 3, wherein the concave part is formed in a region sandwiched by the first protruding part and the second protruding part in the bottom surface of the exterior material.

9. The resistor according to claim 8, wherein the second protruding part, the bottom surface of the resistor substrate, and the edge of the metal bush are at the same height along the thickness of the exterior material, and the first protruding part has a higher height than said same height.

10. The resistor according to claim 8, wherein when the resistor is mounted on a mounting object using a fastening body for passing through the through-hole, a protruding surface of the first protruding part makes surface contact with the mounting object, and the second protruding part adheres to the mounting object.

11. The resistor according to claim 3, wherein the second protruding part, the bottom surface of the resistor substrate, and the edge of the metal bush are at the same height along the thickness of the exterior material, and the first protruding part has a higher height than said same height.

12. The resistor according to claim 11, wherein when the resistor is mounted on a mounting object using a fastening body for passing through the through-hole, a protruding surface of the first protruding part makes surface contact with the mounting object, and the second protruding part adheres to the mounting object.

13. The resistor according to claim 3, wherein when the resistor is mounted on a mounting object using a fastening body for passing through the through-hole, a protruding surface of the first protruding part makes surface contact with the mounting object, and the second protruding part adheres to the mounting object.

14. The resistor according to claim 1, wherein the first protruding part is either configured by a single protruding part extending along the entire width in an orthogonal direction to the longitudinal direction of the bottom surface of the exterior material while having a constant width, or configured by a regular shaped protruding part divided into either end part in the orthogonal direction to the longitudinal direction of the bottom surface of the exterior material.

* * * * *